United States Patent [19]

Keneson

[11] Patent Number: 4,575,971

[45] Date of Patent: Mar. 18, 1986

[54] DEVICE FOR HOLDING AND AIDING IN THE SHARPENING OF WELDING RODS

[76] Inventor: Jerry L. Keneson, 3200 Hospital Rd., #34, Tacagoula, Miss. 39567

[21] Appl. No.: 546,951

[22] Filed: Oct. 31, 1983

Related U.S. Application Data

[63] Continuation-in-part of Ser. No. 442,303, Nov. 17, 1982, abandoned.

[51] Int. Cl.[4] ..... B24B 5/18

[52] U.S. Cl. ..... 51/236; 51/281 R

[58] Field of Search ..... 51/236, 217 T, 229, 51/281 R; 269/69; 248/354.5

[56] References Cited

U.S. PATENT DOCUMENTS

| | | | |
|---|---|---|---|
| 40,386 | 10/1863 | Williams . | |
| 142,552 | 9/1873 | Barnum | 51/236 |
| 1,430,063 | 9/1922 | Diesel et al. . | |
| 1,873,067 | 8/1932 | Stromgren . | |
| 2,054,159 | 9/1936 | Holcomb | 51/229 |
| 2,264,179 | 11/1941 | Johnson . | |
| 2,365,385 | 12/1944 | Booth | 51/236 |
| 2,446,255 | 8/1948 | Vocisano | 248/354.5 |
| 2,551,721 | 5/1951 | Borzi . | |
| 2,588,758 | 3/1952 | Pilj | 51/236 |
| 2,687,268 | 8/1954 | Hawes | 248/354.5 |
| 2,818,687 | 1/1958 | Quimby . | |
| 3,125,836 | 3/1964 | Printz | 51/229 |
| 3,356,329 | 12/1967 | Santo | 248/354.5 |
| 3,376,674 | 4/1968 | Ernesto . | |
| 3,862,516 | 1/1975 | Broscoff et al. . | |
| 4,258,907 | 3/1981 | Roberts | 269/69 |
| 4,265,057 | 5/1981 | Hoffman | 51/229 |

FOREIGN PATENT DOCUMENTS

| | | | |
|---|---|---|---|
| 697894 | 1/1931 | France | 48/354.5 |

*Primary Examiner*—Harold D. Whitehead

*Attorney, Agent, or Firm*—Cushman, Darby & Cushman

[57] ABSTRACT

A device for holding and aiding in the sharpening of welding rods includes an elongated handle member defining an axial elongated cavity into which a workpiece can be inserted and housed. The exterior of the handle member can be firmly grasped so that a user can manually bring the exposed end of the workpiece into and out of proximity with a grinding tool to sharpen the end of the workpiece to a desired degree. A plurality of threaded apertures communicating with and transverse to the cavity are defined in the handle a predetermined axial distance from one another. At least one thumb-screw having a depending nib is threadably engaged with a preselected one of the apertures, thereby extending the nib into the cavity to obstruct it. When the elongated workpiece is inserted into the cavity, one end of the workpiece abuts the nib to determine the axial position the workpiece in the cavity. The rib is arcuately shaped to reduce the surface area of the nib contacting the end of the rod, thereby permitting the elongated workpiece to freely axially spin within the cavity. The preselected one of the apertures into which the thumb-screw is engaged may be selected so that an end of the workpiece extends a desired length beyond the distal end of the handle member. When the exposed end of the workpiece is brought into oblique contact with the rotating abrasive wheel of a grinding tool, a tapered point may be easily formed on the end of the workpiece.

18 Claims, 2 Drawing Figures

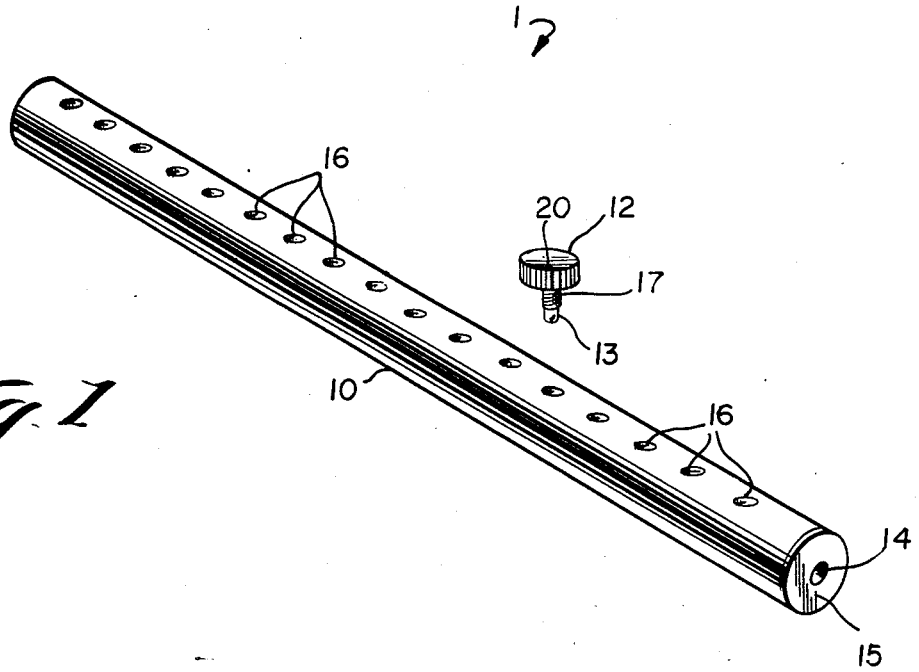
Fig. 1
Fig. 2
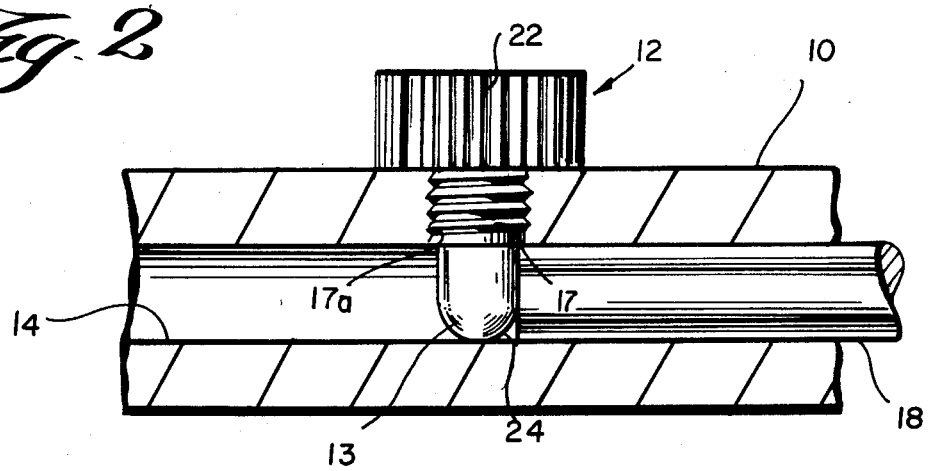

DEVICE FOR HOLDING AND AIDING IN THE SHARPENING OF WELDING RODS

CROSS-REFERENCES TO RELATED APPLICATION

This is a continuation-in-part of application Ser. No. 442,303 filed on Nov. 17, 1982, and now abandoned, the entire disclosure of which is expressly incorporated hereinto by reference.

FIELD OF THE INVENTION

The present invention relates to a device for retaining an elongated workpiece so that an end of the workpiece may be worked, such as by grinding or the like. The present invention is particularly suitable for use any time rod-like, elongated workpieces of various lengths are required to be rotatably retained by a handle member so that only a predetermined length of one end of the workpiece extends from the distal end of the handle. The invention is particularly applicable to retaining tungsten arc-welding rods as they are sharpened by being brought into grinding proximity with a rotating abrasive grinding wheel.

BACKGROUND OF THE INVENTION

Welding is a common method of fastening two pieces of metal or other material together. Generally, two surfaces to be joined are locally heated by a heat source to a molten state, causing molten material to flow into the gap between the surfaces. The molten material solidifies when the source of heat is removed to form a permanent bond joining the two surfaces together.

There are a variety of known methods of heating material to a molten state to form a weld. One common method is arc-welding, which generates the heat required for welding by passing a very high electrical current through the pieces to be welded. Because the material to be welded must be electrically conductive and because this method of welding is capable of generating very high temperatures, it is often the method of choice for joining pieces of metal such as steel or cast iron.

One pole of the electrical source (normally the negative or ground connection) is electrically connected to the work to be welded, while an electrode is connected to the other pole thereof. When the electrical source is activated, an extremely high electric current (150–2000 amperes, depending upon the particular electrical source used) causes the air in the gap between the work and the electrode to ionize and thus form an electrical arc when the electrode is brought into close proximity to the work. The part of the work exposed to the electrical arc is locally heated to a molten state by the very high electrical current flowing through it.

The shape of the electrode of an arc-welder must be of special design in order to facilitate both ionization of the air gap and accurate positioning and shaping of welds. The composition of the electrode is critical because it, too, is exposed to extremely high currents which could cause it to melt. Replaceable arc-welding rods are conventionally used as the electrode.

Conventional arc-welding rods are of two general types: consumable and non-consumable. Consumable welding rods have a melting temperature approximately equal to that of the work to be welded, and usually have somewhat the same metallurgical composition as that of the work (together with additives to produce welds with predetermined desirable properties). When an electrical arc ionizes the air gap between the work and welding rod, both the work and the tip of the consumable welding rod are heated to the molten state. The molten material at the end of the welding rod is used as filler metal to form part of the weld. Non-consumable welding rods, on the other hand, are composed of materials with extremely high melting points (such as carbon or tungsten). Non-consumable rods do not melt during the welding process and are used merely as inert electrodes from which electrical arcs may emanate.

Non-consumable welding rods are, however, subject to vaporization and oxidation due to exposure to the very high temperatures of welding, and thus are in fact eventually consumed (although much more slowly than the consumable rods). Oxidation is largely prevented by "shielding" the welding rod during welding by exhausting a quantity of inert gas (suitably helium, argon, helium-argon mixtures or carbon dioxide) around the tip of the rod. Even so, the rod tip still oxidizes slightly, and is subject to vaporization due to the extremely high temperatures present at the tip of the rod. Since the shape of the end of the rod is critical to the ability to easily form an arc and to control the direction of that arc once it is formed (e.g. so that welds may be precisely positioned and shaped), the working end of a non-consumable rod must therefore be periodically worked (e.g. sharpened) in order to maintain a point or other desired shape.

Conventionally, non-consumable tungsten arc-welding rods are in the form of thin rods of solid tungsten (available in various standard diameters from 1/16 to 3/16 of an inch) approximately 7 inches long. One end of the tungsten rod must be sharpened to a point before use so as to provide the welder with the ability to control the direction of the arc when formed and thus permit precise welding. Sharpening of the tungsten rod is conventionally accomplished by using a rotating abrasive grinding wheel such as a conventional bench grinding wheel or side grinding wheel. A pointed end with an even taper about the circumference of the welding rod is desirable so that the welding arc will extend axially from the tip of the rod when in use.

Welders will typically manually grasp the tungsten rod during its sharpening and thus will bring it into sharpening proximity with the rotating grinding wheel. This conventional sharpening practice is relatively dangerous because the rod will exhibit a tendency to slip out of contact with the wheel, causing potential serious bodily injury to the welder if his hands should strike the rotating wheel. Moreover, severe burns can result from grasping welding rods that have not yet cooled completely from the welding process. Because tungsten is a relatively expensive material, it is desirable to use as much of the welding rod as possible. Thus, it is often necessary to sharpen the end of relatively small length welding rod. It is extremely difficult for a welder to manually grasp such a short length of rod to accurately sharpen it and thus this factor also increases the danger of injury to the hands due to possible slippage of the rod on the grinding wheel. Moreover, it is extremely difficult to steady a short piece of welding rod to achieve a desired even-tapered point in accordance with conventional practices.

Fixtures for retaining rod-like workpieces so that the end of the workpiece may be easily worked are, of course, well known in the art. In this regard, the reader's attention is directed to the following list of patents (which is by no means exhaustive) so that further insight into the novel aspects of the present invention can be gleaned. Borzi (U.S. Pat. No. 2,551,721 issued May 8, 1951) discloses a fixture for retaining a bullet-shaped workpiece so that the end of the workpiece may be ground; Holcomb (U.S. Pat. No. 2,054,159 issued Sept. 15, 1936) discloses a handle member for retaining a pivot pin so that a conical bearing may be ground on the end of the pin; Stromgren (U.S. Pat. No. 1,873,067 issued Aug. 23, 1932) discloses a fixture for retaining a valve stem while the end of the valve stem is ground; Broscoff et al (U.S. Pat. No. 3,862,516 issued Jan. 28, 1975) discloses a vise for retaining the cap of a screw or bolt while the end of the screw or bolt is worked; Ernesto (U.S. Pat. No. 3,376,674 issued Apr. 9, 1968) discloses a fixture for retaining a punch while an angled surface is cut into it; Diesel et al (U.S. Pat. No. 1,430,063 issued Sept. 26, 1922) discloses a jig for retaining a lamp reflector for polishing.

As the reader will appreciate from careful consideration of the discussion which follows, the present invention is a novel device for retaining tungsten welding rods while they are being sharpened which permits easy and accurate shaping of the end of the rod without the associated dangers of physical injury to the welder presented by conventional sharpening techniques.

SUMMARY OF THE INVENTION

The present invention is a device for holding and aiding in the sharpening of welding rods and more particularly, nonconsummable tungsten welding rods. An elongated handle member defines an axially oriented elongated cavity into which a tungsten arc-welding rod can be inserted and housed in such a manner that a portion of one end of the rod extends beyond the forward end of the handle. The exterior of the handle member can be firmly grasped so that a user can manually bring the exposed end of the rod into and out of proximity with a grinding tool so as to sharpen the exposed end to a desired degree.

A plurality of threaded apertures communicating with and transverse to the cavity are defined in the handle and are separated from one another by a predetermined axial distance. At least one thumb-screw having a depending nib is threadably engaged with a preselected one of the apertures. When the thumb-screw is engaged with the apertures, the nib extends into the cavity to substantially obstruct it.

A tungsten welding rod may thus be inserted into the cavity so that one end of the rod bears against the nib of the thumb-screw to axially position the rod in the cavity. The particular aperture with which the thumb-screw is engaged is selected so that a portion of the welding rod will extend a desired length beyond the distal end of the handle. The welding rod is permitted to freely axially spin within the cavity due to its contact with the smooth, rounded surfaces of the nib.

A user firmly grasps the handle and positions it so that the extended end of the welding rod is in close proximity to the rotating abrasive wheel of a grinding tool. The end of the rod is brought into contact with the rotating wheel, causing small amounts of material to be removed from the end of the rod. The welding rod responsively spins axially within the cavity due to the rotational force of the wheel thus forming an evenly-tapered point on the end of the rod.

BRIEF DESCRIPTION OF THE ACCOMPANYING DRAWINGS

A more complete understanding of this invention and appreciation of its improvements and advances may be obtained from the following detailed description of the accompanying drawings wherein like reference numerals throughout the various figures denote like structural elements and wherein:

FIG. 1 is a perspective view of a presently preferred exemplary embodiment of the present invention; and FIG. 2 is a fragmentary cross-sectional view of the preferred embodiment of FIG. 1.

DETAILED DESCRIPTION OF THE PREFERRED EMBODIMENT

A particularly preferred exemplary embodiment of device 1 of the present invention is depicted in FIG. 1 and generally includes a handle 10 and a threadably removable thumb-screw 12. The handle 10 may suitably be a cylindrical rod composed of steel or some other durable, rigid material. An axial elongated cavity 14 is substantially centrally defined in the handle 10 and preferably traverses the entire axial length of handle 10. A plurality of threaded apertures 16 are drilled into the handle 10 transverse to cavity 14 (suitably perpendicular to the cavity 14) at a predetermined spacing along the handle. Thumb-screw 12 having a dependent nib 13 can be threadably engaged with any one of apertures 16 in a preselected manner, the purpose of which will become more clear from the discussion which follows.

Referring more particularly to FIG. 2, thumb-screw 12 is threadably engaged with a preselected one of apertures 16 so that nib 13 extends into and substantially occludes cavity 14 to thereby establish a dimension between nib 13 and forward end 15 of handle 10. A tungsten welding rod 18 is then inserted into cavity 14 so that one end of rod 18 abuts nib 13 to thereby axially position rod 18 within cavity 14. The distance which an end of rod 18 extends from the forward end 15 of handle 10 may thus be varied by selecting the one of apertures 16 with which thumb-screw 12 is engaged so as to vary the established dimension between nib 13 and forward end 15 in a desired manner.

Rod 18 may suitably be a solid nonconsummable tungsten arc-welding rod having a length of approximately 7 inches and a diameter ranging in standard increments between 1/16 to 3/16 of an inch. Cavity 14 suitably has a diameter slightly larger than the diameter of rod 18 to permit rod 18 to axially rotate freely within the cavity. Thus, cavity 14 may have a diameter of $\frac{1}{8}$ of an inch (to accommodate rods with diameters of 3/32 to $\frac{1}{8}$ of an inch), 3/32 of an inch (to accommodate rods with diameters of 1/16 of an inch), or 3/16 of an inch (to accommodate rods with diameters of 5/32 to 3/16 of an inch).

The length of handle 10 may suitably be $6\frac{3}{8}$ of an inch to accomodate any length of welding rod between a new rod (e.g. 7 inches in length) to a very short, used rod (e.g. 1 inch in length). Suitably, the end of rod 18 should normally extend approximately $\frac{5}{8}$ of an inch from the distal end of handle 10 during sharpening to permit formation of a taper of appropriate length and to prevent mechanical interference between handle 10 and a grinding tool (not shown) while still yielding sufficient rigidity of the extending end of the rod to permit accurate shaping of the point. The spacing between apertures 16 may suitably be $\frac{3}{8}$ of an inch. The diameter of the apertures may suitably be 5/16 of an inch (for handles having a cavity of $\frac{1}{8}$ inch in diameter), 3/32 of an inch (for handles having a cavity of 3/32 inch in diameter), and 3/16 of an inch (for handles having a cavity of 3/16 inch in diameter).

To use the present invention, a welding rod 18 is inserted into cavity 14 until only approximately $\frac{5}{8}$ of an inch protrudes from the distal end 15 of the handle 10. The user visually inspects the various apertures 16 to determine which aperture is closest to the end of rod 18 housed in cavity 14 and selects one of apertures 16 to be engaged with threaded thumb-screw 12. The user then engages the threads 17 of thumb-screw 12 with the threads 17*a* of the selected aperture 16, by inserting nib 13 into the selected aperture to contact threads 17 and 17*a*, and rotating disk 20 of the thumb-screw (suitably in a clockwise direction). The cylindrical sides of disk 20 define plural ridges 22 to permit the welder to easily grasp and rotate the disk. When threads 17 engage threads 17*a*, nib 13 occludes cavity 14. Rod 18 is then further inserted into cavity 14 until it abuts against nib 13. The user then examines the length of rod 18 protruding from the distal end of handle 10 to determine if the exposed length is as desired. The user may select another one of apertures 16 to engage with thumb-screw 12 to accurately determine a desired protruding length of rod 18 which is suitably approximately $\frac{5}{8}$ of an inch, but may vary from user to user, from one grinding machine to another or with the diameter of rod 18.

The user can now firmly grasp handle 10 and position it so that the protruding end of rod 18 is brought into sharpening proximity with the rotating abrasive wheel of a grinding tool. When rod 18 contacts the rotating wheel at an angle oblique to the plane of the wheel, some of the material from the end of rod 18 is removed.

Nib 13 of thumb-screw 12 defines a substantially cylindrical or spherical structure with a very smooth, polished surface. Nib 13 preferably terminates in a hemispherical portion 24. Due to the curvature of hemispherical portion 24, only a small portion of the total surface area of nib 13 contacts the end of rod 18, reducing the friction between the rod and the nib. Furthermore, nib 13 may be shaped spherically rather than cylindrically to further reduce the surface area contacting rod 18. Little resistance is offered by nib 13 to the rotation of rod 18 due to the shape and smoothness of the nib, permitting the rod to freely axially spin within cavity 14. The rotation of the grinding wheel and its angular contact with rod 18 thus translates into an axial spin of rod 18 within cavity 14, causing approximately equal amounts of material to be removed about the circumference of rod 18 so as to permit a tapered point on the end of rod 18 to be formed. Depending upon the diameter of rod 18, the method of grinding used and the angle of the taper, a tapered point may be formed on the end of rod 18 in approximately 60 seconds.

While the invention has been herein shown and described in what is presently conceived to be the most practical and preferred embodiment thereof, it may be apparent to those of ordinary skill in the art that many modifications may be made thereof within the scope of the invention. For instance, the diameter, shape and length of the cavity, the diameter, number, shape and spacing of the apertures, and the length and shape of the handle may all be changed while retaining the useful features and advantages of the present invention. The scope of the present invention shall therefore be accorded the broadest interpretation of the appended claims so as to encompass all equivalent devices, assemblies and/or methods.

What is claimed is:

1. A device for assisting in the sharpening of an end of an elongated workpiece, said device comprising:

an elongated member including means defining an axial cavity into which one end of said workpiece is receivable, means defining an interior surface bounding said cavity, and means defining plural axially spaced apart apertures transverse to and communicating with said cavity; and adjusting means, selectively engageable with any selected one of said apertures and movable between said selected one and another one of said apertures, for adjusting the length that another end of said workpiece is exposed beyond the terminal end of said member, said adjusting means including means defining a determining nib occluding substantially all of a cross-section of said cavity when said adjusting means is engaged with said selected aperture, said workpiece one end abutting against said determining nib, said nib including means for permitting said workpiece to axially spin in contact with said interior surface and said nib to thereby evenly sharpen said another end of said workpiece when said member is manually brought into sharpening proximity with a sharpening tool, said spin-permitting means including means defining a smooth, convex curved surface terminating in a hemispherical portion, said terminating hemispherical portion contacting said interior surface at a point on said interior surface opposite said selected aperture when said adjusting means is engaged with said selected aperture.

2. A device as in claim 1 wherein:

said apertures-defining means also defines a plurality of threads within each of said apertures; and said adjusting means further includes means defining a plurality of threads for engaging with said threads of said apertures, said terminating hemispherical portion contacting said interior surface bounding said axial cavity when said threads of said adjusting means are fully engaged with said threads of said apertures.

3. A device as in claim 2 wherein said smooth, convex arcuate surface on said determining nib reduces the surface area of said determining nib in contact with said workpiece one end to permit said workpiece to freely axially spin.

4. A device as in claim 3 wherein said arcuate surface defined by said curved surface-defining means is spherical in shape.

5. A device as in claim 1 wherein said axial cavity has a circular diameter of $\frac{1}{8}$ of an inch.

6. A device as in claim 1 wherein said axial cavity has a circular diameter of 3/32 of an inch.

7. A device as in claim 1 wherein said axial cavity has a circular diameter of 3/16 of an inch.

8. A device as in claim 1 wherein said apertures-defining means defines said apertures $\frac{3}{8}$ of an inch apart from one another along the entire length of said cavity.

9. A device as in claim 1 wherein said elongated member has a length of $6\frac{3}{8}$ inches.

10. A device as in claim 1 wherein said cavity traverses substantially the entire length of said elongated member.

11. A device as in claim 10 wherein said apertures-defining means defines plural apertures evenly-spaced axially along substantially the entire length of said elongated member.

12. A device as in claim 11 wherein said plural apertures all lie along a common line axial to said elongated member.

13. A device as in claim 1 wherein said adjusting means comprises means for selectively occluding said cavity at said selected one of said apertures.

14. A device as in claim 1 wherein:

said adjusting means includes means for engaging with said selected one of said apertures; and the length that said first end of said workpiece is exposed beyond the terminal end of said member is dependent upon which one of said plural apertures is said selected one.

15. A device as in claim 1 wherein said determining nib has a cross-sectional diameter which is slightly less than the diameter of said cavity.

16. A method for sharpening a first end of an elongated workpiece comprising the steps of:

inserting a second end of said elongated workpiece into an axial cavity defined by an elongated member having means defining plural axially spaced apart apertures transverse to and communicating with said cavity;

engaging an adjusting means for obstructing said cavity with a selected one of said plural apertures;

abutting said second end of said elongated workpiece against said adjusting means; and sharpening said first end of said elongated workpiece by contacting said first end at an oblique angle with a rotating abrasive wheel of a grinding tool, said sharpening step including the step of axially spinning said workpiece within said cavity under force applied to said workpiece by said grinding tool as material is removed from said first end.

17. A method as in claim 16 further comprising the steps of:

determining the length of said first end of said workpiece extending beyond a terminal end of said elongated member;

deciding whether said determined extending length is suitable for carrying out said sharpening step; and repeating said engaging step for another predetermined one of said apertures together with said abutting step and said determining step until said extending length of said determining step is suitable for said sharpening step.

18. A method as in claim 16 further comprising the step of visually inspecting the position of said second end of said elongated workpiece through said apertures to determine said selected one of said apertures of said engaging step.

* * * * *